US007388354B2

(12) United States Patent
Nastase

(10) Patent No.: US 7,388,354 B2
(45) Date of Patent: Jun. 17, 2008

(54) METHODS AND DEVICES FOR LOW NOISE CURRENT SOURCE WITH DYNAMIC POWER DISTRIBUTION

(75) Inventor: Adrian S. Nastase, Huntington Beach, CA (US)

(73) Assignee: Newport Corporation, Irvine, CA (US)

( * ) Notice: Subject to any disclaimer, the term of this patent is extended or adjusted under 35 U.S.C. 154(b) by 420 days.

(21) Appl. No.: 11/102,961

(22) Filed: Apr. 11, 2005

(65) Prior Publication Data

US 2005/0226019 A1 Oct. 13, 2005

Related U.S. Application Data

(60) Provisional application No. 60/561,326, filed on Apr. 12, 2004.

(51) Int. Cl.
*G05F 1/613* (2006.01)

(52) U.S. Cl. ..... 323/224; 323/273; 323/282

(58) Field of Classification Search ..... 323/224, 323/234, 266, 268, 271, 273–279, 281–285
See application file for complete search history.

(56) References Cited

U.S. PATENT DOCUMENTS

2004/0008016 A1* 1/2004 Sutardja et al. ..... 323/283

OTHER PUBLICATIONS

PCT International Search Report and Written Opinion for PCT/US05/12174; Completed, Dec. 11, 2007; Mailed, Jan. 4, 2008.

* cited by examiner

*Primary Examiner*—Adolf Berhane
(74) *Attorney, Agent, or Firm*—Grant Anderson LLP

(57) ABSTRACT

Systems and methods for increasing driver power dissipation efficiency in a low noise current supply utilizing a power supply and a voltage regulator to power an output current regulator. An analog processing circuit adjusts the voltage drop on the voltage regulator, to make it equal with the voltage drop on current regulator.

3 Claims, 5 Drawing Sheets

METHODS AND DEVICES FOR LOW NOISE CURRENT SOURCE WITH DYNAMIC POWER DISTRIBUTION

CROSS REFERENCE TO RELATED APPLICATIONS

This application claims priority from now abandoned U.S. Provisional Patent Application Ser. No. 60/561,326, filed Apr. 12, 2004, by Adrian S. Nastase, titled "POWER DISTRIBUTION OVER MULTIPLE HEAT SINKS FOR LASER DIODE DRIVES AND LOW NOISE CURRENT SOURCES", the entirety of which is incorporated by reference herein.

BACKGROUND

Devices such as laser diode drivers, thermoelectric cooler (TEC) controllers and the like, need a source of AC or DC current with an acceptable level of stability and noise. Low noise current sources generally need to deliver AC or DC current, based on an input signal, with an acceptable level of stability and noise. Such current sources typically require the use of a current regulator, which may be a transistor. Depending on the output current and voltage drop across the current regulator, there may be significant heat generated by the current regulator which must then be dissipated by a heat sink or other suitable device. In addition, for applications where the output current must have low noise, a voltage regulator may be required in the current source to reject or otherwise suppress the power supply ripple. The voltage regulator may also have a heat sink to dissipate heat generated by a voltage drop across the voltage regulator.

One conventional way to design a current source uses an unregulated power supply connected to a voltage regulator which is in turn coupled to a current regulator. Both the voltage regulator and the current regulator may be transistors. In such a system, power dissipates independently, and typically, unevenly on the heat sinks of the voltage regulator and current regulator, making the power dissipation inefficient. Another conventional design for a current source uses an unregulated power supply to provide power to a transistor that is used for a current regulator without the use of a voltage regulator. However, this system has only one heat sink for heat dissipation which is coupled to the current regulator. In addition, the voltage drop on the current regulator must be high enough to reduce the ripple noise of the input power, and this leads to more power dissipation in the single heat sink. These factors may also result in an inefficient dissipation of excess power in the current source.

Some other methods use a switching power supply to power the current regulator. Sometimes the switching power supply is adjusted by software or calibration to maintain the minimum voltage drop on the current regulator and minimize dissipation. The heat is then at least partially dissipated in the switching power supply. The disadvantage of using a switching power supply that supplies power directly to the current regulator is the noise that is produced in the output current. The prior art systems and methods either produce uneven power dissipation between the various components, or produce noise in the regulated current. What has been needed is a low noise current supply with efficient heat dissipation.

SUMMARY

Embodiments of this invention relate generally to electro-optics, and more specifically to low noise current sources and electronic driver circuits for supplying electric current to continuous wave laser diodes, TEC controllers and the like. In one embodiment, a method of efficiently dissipating heat in a low noise current source, includes providing a current source having a voltage regulator and a current regulator which is electrically coupled to the voltage regulator. Measuring the voltage drop across the voltage regulator and measuring the voltage drop across the current regulator. The voltage drop across the voltage regulator is then adjusted to substantially match the voltage drop across the current regulator. For some embodiments, the voltage drop across the voltage regulator may be adjusted to substantially match the voltage drop across the current regulator by a processing device which may be an analog processing circuit, an integrated circuit, a microprocessor or the like.

In another embodiment, a low noise current source includes a voltage regulator which includes a heat sink thermally coupled thereto and a current regulator which has a heat sink thermally coupled thereto and which is electrically coupled to the voltage regulator. A processing device is electrically coupled to an input of the voltage regulator, an output of the voltage regulator and an output of the current regulator. The processing device is also coupled to the voltage regulator and configured to regulate a voltage drop across the voltage regulator to match a voltage drop across the current regulator.

In another embodiment, a method of efficiently dissipating heat in a low noise current source, includes providing a current source having a power supply, a voltage regulator which has a heat sink coupled thereto and which is electrically coupled to the power supply and a current regulator which has a heat sink thermally coupled thereto and which is electrically coupled to the voltage regulator. Measuring a power supply output voltage and measuring a current regulator output voltage. Adjusting a voltage drop across the voltage regulator to substantially match a voltage drop across the current regulator.

These features of embodiments will become more apparent from the following detailed description when taken in conjunction with the accompanying exemplary drawings.

DETAILED DESCRIPTION

As discussed above, devices such as laser diode drivers, thermoelectric cooler (TEC) controllers and the like, need a source of AC or DC current with an acceptable level of stability and noise. Low noise current sources generally need to deliver AC or DC current, based on an input signal, with an acceptable level of stability and noise. Such current sources typically require the use of a current regulator, which may be a transistor. Depending on the output current and voltage drop across the current regulator, there may be significant heat generated by the current regulator which must then be dissipated by a heat sink or other suitable device. In addition, for applications where the output current must have low noise, a voltage regulator may be required to reject the power supply ripple. The voltage regulator may also have a heat sink to dissipate heat generated by the power related to a voltage drop across the voltage regulator.

The size of a heat sink or heat sinks required for a particular current source depends on the output power requirements for the current source. Depending on the load being supplied by the current source at any given moment, the power directed into the load may be totally or partially a function of the load size. In situations where the load is small, power in the form of heat may need to be dissipated in the current source itself, and particularly, excess power may need to be dissipated on the heat sink of the current regulator. Laser diode drivers, TEC controllers, and low noise current sources may also be required to produce power having very low noise, about tens of parts per million (ppm) in some embodiments. Therefore, power supply ripple delivered to the current regulator needs to be minimized.

Figure 1:
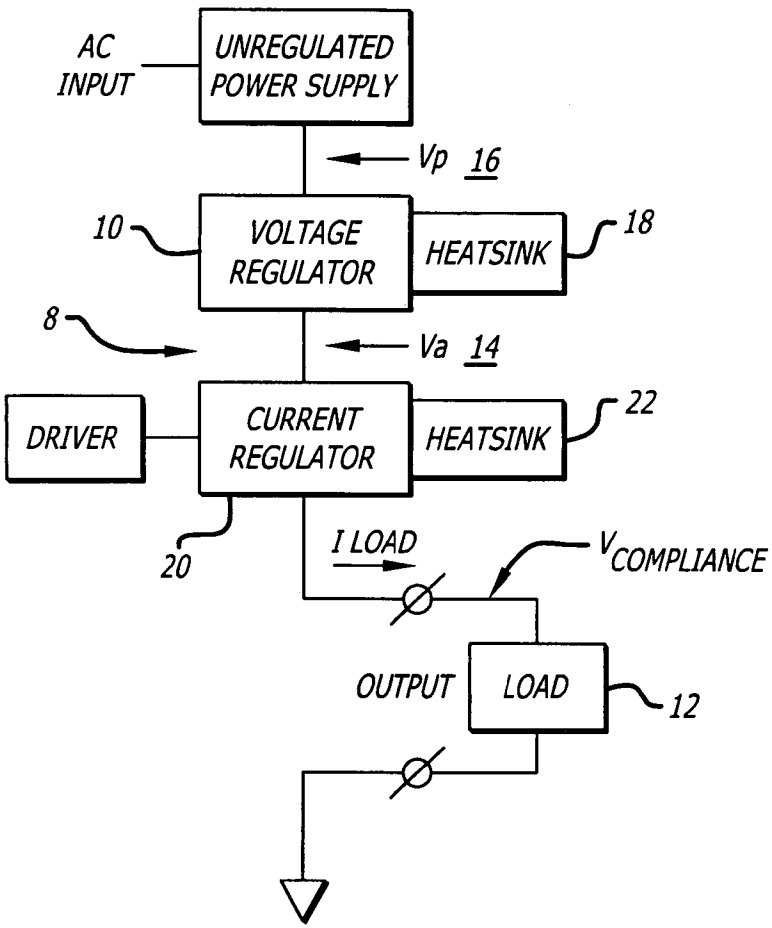
FIG. 1 (Prior Art)
FIG. 1 shows a prior art current source with a fixed voltage regulator.

One prior art embodiment of a current source 8 that is configured to address power supply ripple includes a voltage regulator 10 with a fixed voltage as shown in FIG. 1. With Va 14 being fixed, voltage regulator 10 power dissipation depends on the output load $I_{load}$ 12 and Vp 16 as in equation (1).

$$P_{voltage_regulator}=I_{load}\cdot(Vp-Va) \quad (1)$$

When Vp 16 increases due to AC voltage increase, the amount of heat voltage regulator 10 needs to dissipate can be significant and heat sink 18 needs to be designed for the maximum Vp level. Power dissipation on current regulator 20 is directly related to the load level. When the load 12 drops depending on the application requirements, the power on current regulator 20 increases as in equation (2).

$$P_{current_regulator}=I_{load}\cdot(Va-V\text{compliance}) \quad (2)$$

One disadvantage of this embodiment is that excess power dissipates independently, and generally, unevenly on heat sink 18 of the voltage regulator 10 and heat sink 22 of the current regulator 20. Therefore, each heat sink 18 and 22 may have a higher temperature than the other at any moment during operation. This configuration may create a hot point or hot points in the current source 8 that can affect the parameters' variation with temperature or decrease reliability. Moreover, the temperature management requirements within the current source 8 may dictate an increase in size of the heat sinks 18 or 22 which increases the size and cost of the current source 8 embodiment.

Figure 2:
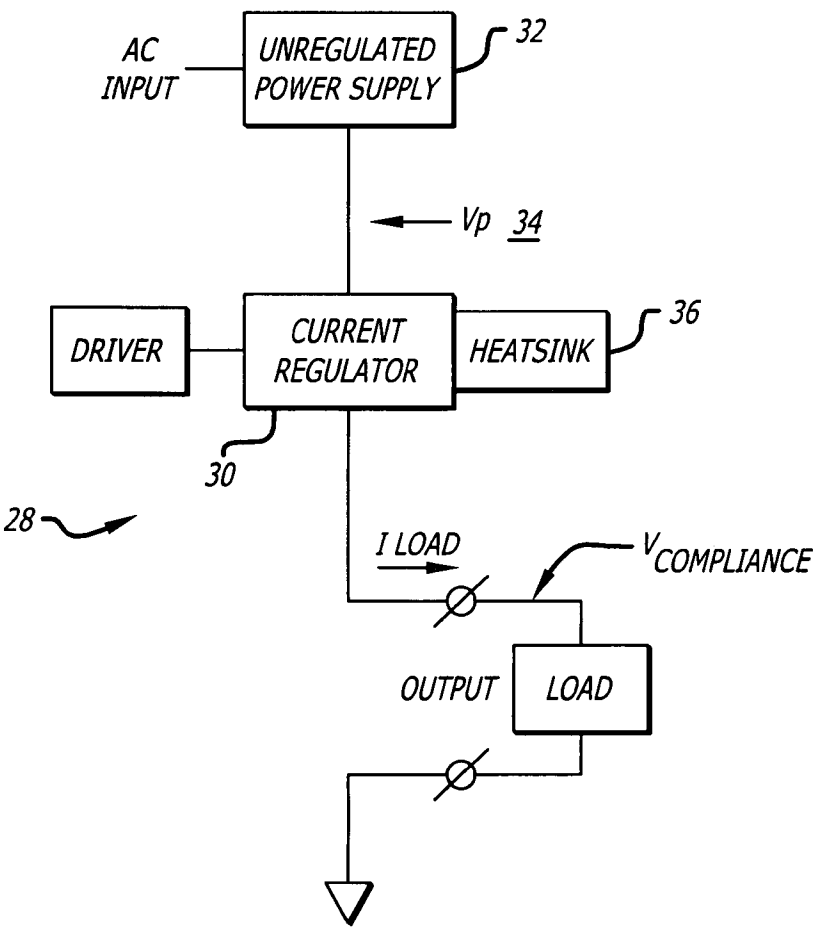
FIG. 2 (Prior Art)
FIG. 2 shows a prior art current source with the current regulator powered directly from the unregulated power supply.

A second prior art embodiment of a current source 28 is shown in FIG. 2. The current source 28 includes a current regulator 30 which is powered directly from an unregulated power supply 32. One disadvantage of this embodiment is that the current regulator 30 needs to dissipate a lot of power because the voltage Vp 34 has to be set to a higher level to accommodate for the AC variation of the power supply 32. Another reason for Vp 34 to be higher is to keep the inherent power supply ripple far from the current regulator 30 transistor saturation region. Another disadvantage of the embodiment shown in FIG. 2 is that the current regulator 30 will use just one heat sink 36. It is well known that one heat sink 36 is less efficient than two heat sinks of the same total area. Therefore, the heat sink 36 needs to be larger than in the previous case increasing the instrument size and cost. Both of the embodiments shown in FIGS. 1 and 2 may require the use of high temperature heat sinks. These embodiments may decrease the reliability of the product and increase the drift with temperature. In situations where high current levels are required, these embodiments will also require large heat sinks.

Some other prior art embodiments of current sources (not shown) use a switching power supply to power the current regulator 30. In some embodiments, the switching power supply is adjusted by software or calibration to maintain the minimum voltage drop on the current regulator 30 to minimize heat dissipation. The heat may then be at least partially dissipated in the switching power supply. The disadvantage of using a switching power supply that supplies power directly to the current regulator 30 is the noise that is produced in the output current.

Figure 3:
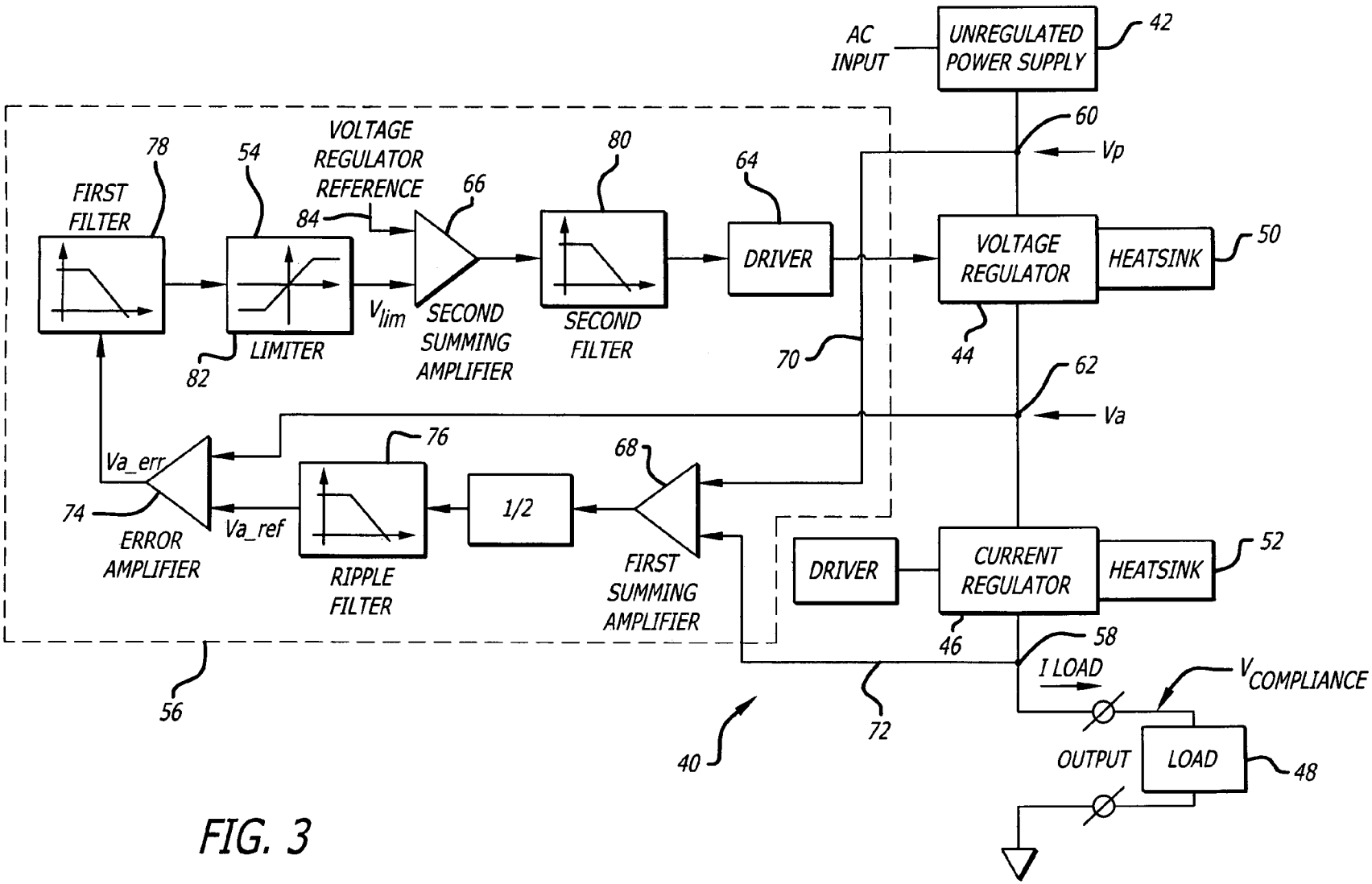
FIG. 3 is a schematic diagram of a current source that allows for dynamic power distribution on multiple heat sinks.

FIG. 3 shows an embodiment of a current source 40 that uses an unregulated power supply 42 electrically coupled to a voltage regulator 44 which is in turn electrically coupled to a current regulator 46 to regulate the current output level to a load 48. Both the voltage regulator 44 and the current regulator 46 may be transistors, such as an RFP 150 MOSFET transistor, manufactured by Intersil Corporation. The voltage regulator 44 has heat sink 50 thermally coupled thereto and current regulator 46 has a heat sink 52 thermally coupled thereto. The voltage regulator 44 has electrical power, either AC or DC, but typically DC with AC ripple, supplied by power supply 42 which is electrically coupled to the voltage regulator 44. The load 48 is electrically coupled to the current regulator 46. A processing device in the form of a processing circuit 54 is indicated by the dashed line enclosure 56 of FIG. 3. The processing circuit 54 monitors the load voltage at the current regulator output 58, Vcompliance, and the unregulated power supply output voltage Vp 60. The processing circuit has an input terminal electrically coupled to the power supply output 60, an input terminal electrically coupled to the voltage regulator output Va 62 and an input terminal electrically coupled to the current regulator output 58. Although the processing circuit 54 shown in FIG. 3 is an analog circuit, the function of the processing device and processing circuit 54 may also be carried out by a digital microprocessor or integrated circuit. Embodiments of the current source 40 may produce output current of up to about 10 Amperes, specifically, up to about 8 Amperes. Such embodiments of the current source 40 may produce output current having a noise ripple of below about 50 micro Amperes rms.

A signal driver 64 of the processing circuit 54 is electrically coupled to the voltage regulator 44 and is configured to regulate a voltage drop across the voltage regulator 44 to match a voltage drop across the current regulator 46 based on a signal from a second summing amplifier 66. Matching of the voltage drop across the voltage regulator 44 to a voltage drop across the current regulator 46 in turn matches power dissipation in the voltage regulator 44 to the power dissipation in the current regulator 46. The equal dissipation of power between the voltage regulator 44 and the current regulator 46 results in more efficient cooling of the current source 40 by avoiding hot spots that would result from uneven power dissipation. Specifically, equal power dissipation produces two or more heat sinks 50 and 52 dissipating a substantially equal amount of power. If the heat sinks have the same power dissipation coefficients, the temperature of the heat sinks 50 and 52 will be substantially the same. As a result, multiple heat sinks 50 and 52 are dissipating heat at a moderate temperature that is lower than a temperature of the hottest heat sink 50 or 52 in a similar system that does not have a processing device 54 and allows uneven power dissipation between heat sinks 50 and 52. Although the current source embodiment 40 illustrated in FIG. 3 shows a processing circuit 54 configured to match heat dissipation between the heat sink 50 of the voltage regulator 44 and the heat sink 52 of the current regulator 46, similar processing circuit 54 embodiments may be configured to match or substantially match the heat dissipation between three or more heat sinks thermally coupled to respective elements of alternative current source embodiments.

The processing circuit also has a first summing amplifier 68 electrically coupled to an output 60 of the power supply 42 by input terminal 70 and an output 58 of the current regulator 46 by input terminal 72, an error amplifier 74 electrically coupled to the first summing amplifier 68, the second summing amplifier 66 electrically coupled to the error amplifier 74 and the driver 64 which is electrically coupled between the second summing amplifier 66 and the voltage regulator 44. A ripple filter 76 may also be electrically coupled between the first summing amplifier 68 and the error amplifier 74. A first filter 78 is electrically coupled between the error amplifier 74 and the second summing amplifier 66 and a second filter 80 is electrically coupled between the second summing amplifier 66 and the driver 64. A limiter 82 is electrically coupled between the error amplifier 74 and the second summing amplifier 66. The term "thermally coupled" is broadly meant to include any coupling between elements that allows for significant transfer of thermal energy between the elements. The term "electrically coupled" is broadly meant to include any coupling between elements that allows for communication of an information signal between the elements, that is at least partially electrical in nature. Electrical coupling may include conductive conduits such as copper wire, but may also include non-conductive conduits such as fiber optic cables and the like.

The processing circuit 54 is configured to measure the voltage Vp where Vp is the voltage of the output 60 of the unregulated power supply 42 (and input 60 of the voltage regulator 44) and voltage Va where Va is the output voltage at 62 of the voltage regulator 44. The processing circuit 54 is also configured to adjust the voltage drop across the voltage regulator 44, Vp−Va, to make it equal with the voltage drop across the current regulator 46, which may be represented by the term Va−Vcompliance, where Vcompliance is the output voltage at 58 of the current regulator 46. At equal voltage drops, the power dissipated on each heat sink 50 is substantially equal to the power dissipated on each heat sink 52, contributing to a lower average temperature on the heat sinks 50 and 52 and eliminating hot spots within the current source 40.

Equation (3) shows a relationship for producing equal voltage drops across the voltage regulator 44 and the current regulator 46.

$$Vp-Va=Va-V\text{compliance} \tag{3}$$

As a result, the power dissipated on each of the voltage regulator 44 and current regulator 46 is equal as in equation (4).

$$P_{voltage_regulator}=P_{current_regulator} \tag{4}$$

where $$P_{voltage_regulator}=(Vp-Va)\cdot I_{load} \text{ and}$$

$$P_{current_regulator}=(Va-V\text{compliance})\cdot I_{load} \tag{5}$$

The condition described by equation (4) exists when Va is half the sum of Vp and Vcompliance as in equation (6).

$$Va=\frac{Vp+Vcompliance}{2} \tag{6}$$

As shown in FIG. 3, the summing amplifier 68 of the processing circuit 54 adds Vp and Vcompliance. Next, the sum of Vp and Vcompliance is divided by 2 by the summing amplifier 68 to create a desired or target voltage Va. Next, the ripple filter 76 reduces the ripple from Vp and/or Va. The desired or target voltage Va may also be denoted by the term Va_ref. The error amplifier 74 then compares Va_ref with Va and generates an error term, denoted Va_err.

The first filter 78 further reduces the noise from the power supply ripple introduced into the first summing amplifier 68 of the processing circuit 54 directly from the unregulated power supply 42. Thereafter, the amplitude of the processing circuit 54 signal is limited by the limiter 82. The output signal from the limiter 82 is denoted with the term Vlim and an equation that may be used to describe the function of the limiter 82 is as follows:

$$V\text{lim}=\begin{cases}\text{Lim}_{11} & \text{if Va_err} > \text{Lim}_{11}\\ \text{Va_err} & \text{if Va_err} \geq \text{Lim}_{12} \text{ and Va_err} \leq \text{Lim}_{11}\\ \text{Lim}_{12} & \text{if Va_err} < \text{Lim}_{12}\end{cases} \tag{7}$$

In equation (7), $\text{Lim}_{11}$ represents the upper limit of Vlim for a positive Va_err value and $\text{Lim}_{12}$ represents the lower limit of Vlim for a negative Va_err value. Vlim may then be fed into the second summing amplifier 66. In the second summing amplifier 66, Vlim may then be added or subtracted from the voltage regulator input reference level 84 to generate an output signal which is directed to the driver 64 which in turn delivers a signal to the voltage regulator 44 to properly adjust the output of the voltage regulator 44 so that Va falls at half the distance between Vp and Vcompliance. A second filter 80 may be disposed between the second summing amplifier 66 and the driver 64 which brings another pole for a higher filter roll-off and noise reduction in the voltage regulator 44.

The processing circuit 54 is configured to dynamically adjust Va so that the power dissipation on heat sinks 50 and 52 is equal at all times. The power distribution is adjusted automatically as the load compliance voltage changes and/or with the AC power voltage variation. This method also increases the effectiveness of the heat sinks 50 and 52, and the equivalent temperature inside the current source 40 instrument decreases. This brings higher reliability and lower drift with temperature, by avoiding the undesired combination of one heat sink 50 or 52 being hot and the other heat sink 50 or 52 being cold. This method may also contribute to low ripple and noise, due to the voltage regulator 44 good power supply rejection ratio. And finally, it is transparent to the user, because the compliance voltage is automatically preserved for any load 48.

The processing circuit 54 can be implemented in a number of ways but the principle used by embodiments of the processing circuit 54 is essentially the same. Various embodiments of the processing circuit 54 perform the following steps: First, Vp and Vcompliance are added and divided by 2. Second, the result is used to adjust the voltage regulator 44 that feeds the current regulator 46 so that equation (3) is true. In an alternative, this method could also be expanded to utilize a plurality of voltage regulators 44, current regulators 46 and heat sinks 50 and 52, and is not limited to two heat sinks 50 and 52.

Figure 4:
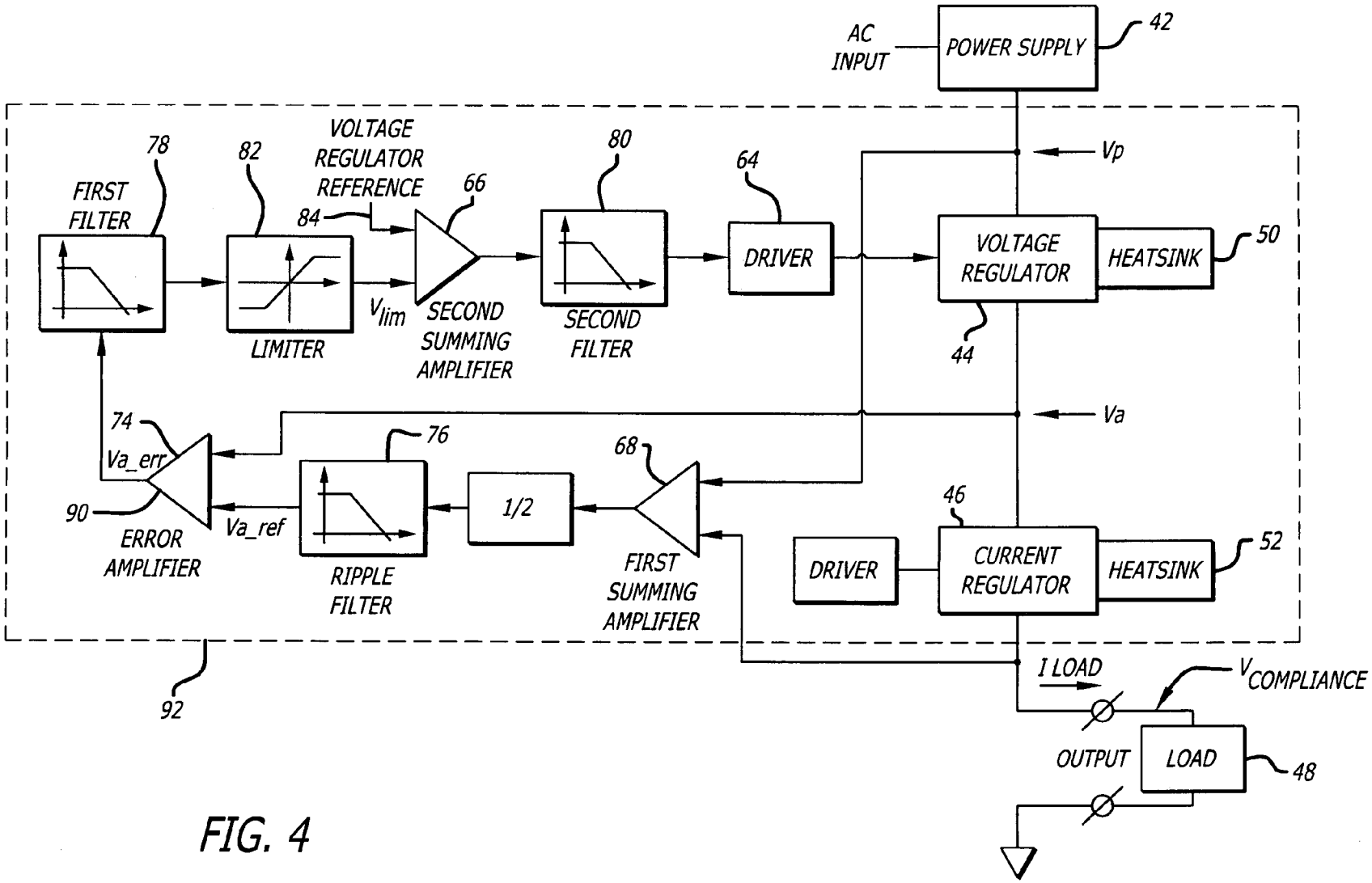
FIG. 4 is a schematic diagram of an alternative embodiment of a current source that integrates the circuit and allows for dynamic power distribution on multiple heat sinks.

Alternative embodiments may all achieve the same result by dynamically maintaining the balanced heat dissipation dictated by equation (3). One alternative includes the use of a monolithic (Integrated) Circuit used as an adjustable voltage regulator. The adjustable input of the voltage regulator can be fed with a processing circuit having the configuration discussed above. However, high power monolithic regulators are not always readily available having voltage output levels above 7V. In addition, the entire current source 40 circuit shown in FIG. 3, with the exception of the power supply 42 and load 48 may be incorporated into a monolithic integrated circuit, or hybrid circuit 90, as shown in the dashed enclosure 92 in FIG. 4. A monolithic or integrated chip 92 can be made available in large scale production as a commercial electronic component to reduce the cost of the device. The electronic components of the integrated circuit 90 may serve the same function as the corresponding components of the current source 40, however they will be in an integrated chip form.

Figure 5:
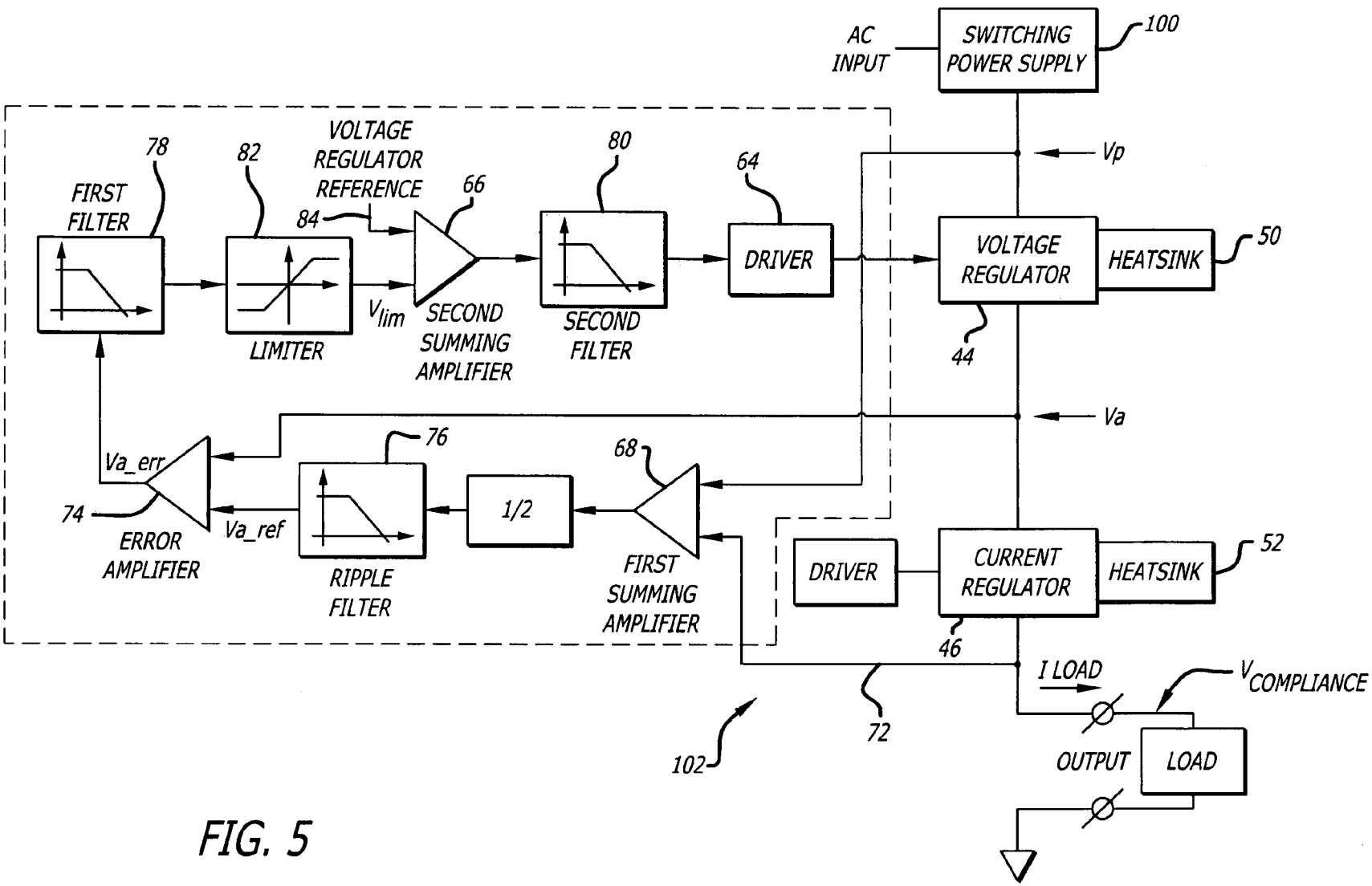
FIG. 5 is a schematic diagram of an alternative embodiment of a current source that incorporates a switching power supply and allows for dynamic power distribution on multiple heat sinks.

Another alternative is to use a switching power supply 100 instead of an unregulated power supply 42, as shown in FIG. 5. This will make Vp fixed but the voltage regulator 44 will be important in reducing the switching power supply 100 noise due to its Power Supply Rejection Ratio (PSRR). In this case the dynamic power distribution will split the heat on the current regulator 46 on two heat sinks 50 and 52 instead of using one heat sink as in the conventional methods. As a consequence the heat sinks' 50 and 52 total area is expected to be smaller than one single heat sink due to the increased efficiency of power dissipation. This advantage, together with the noise reduction, makes the method very attractive for the design of a low noise current source 102 with a switching power supply 100. In another alternative this method can be implemented with programmable analog arrays (not shown) that have started to gain a wide acceptance among circuit designers. System embodiments may be configured to use low cost, generic parts, and can be used for high power applications. No special transistors or parts need to be used, however, the transistors used as regulators have to be capable of driving the load required by application.

Figure 6:
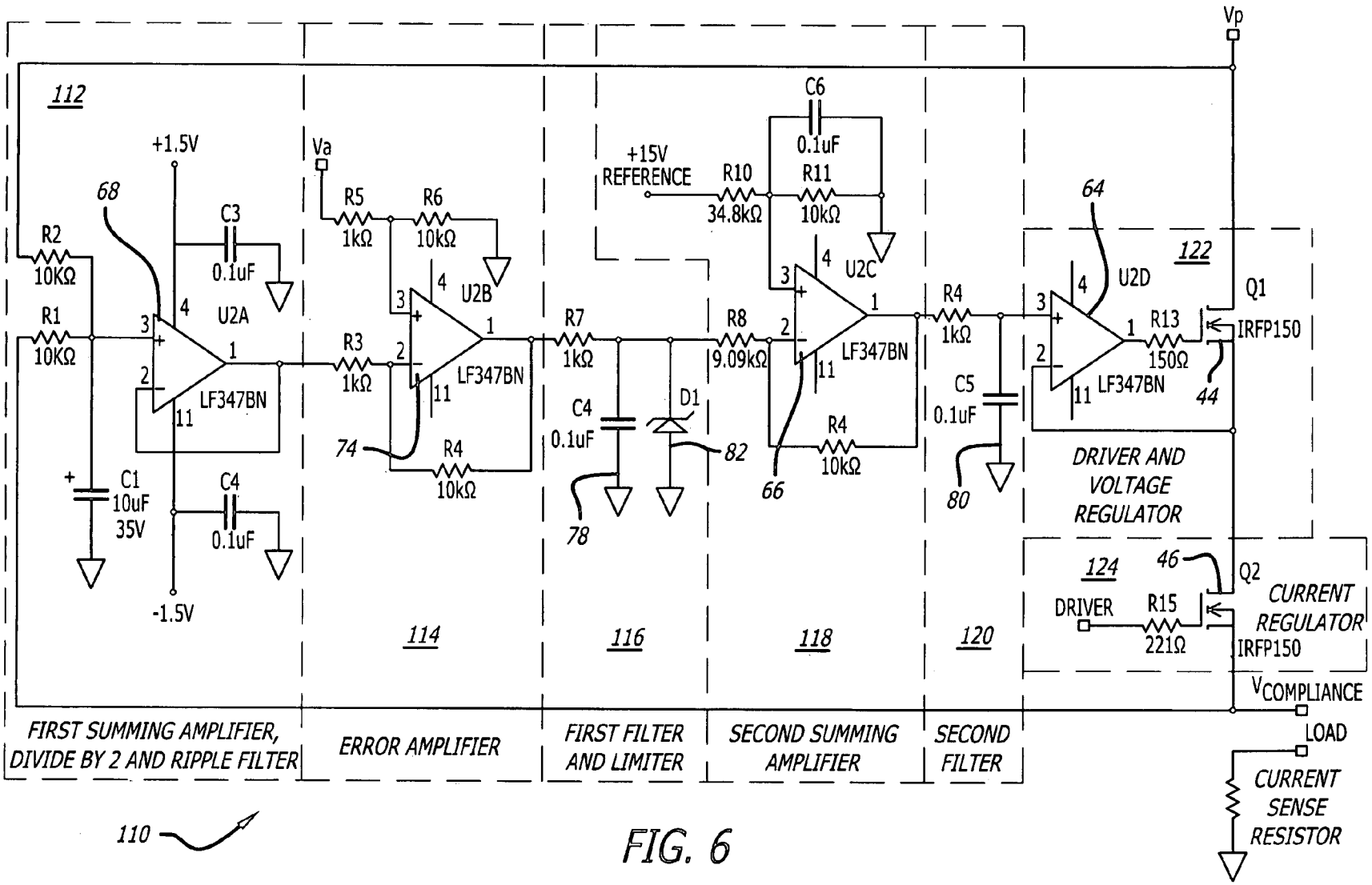
FIG. 6 is a schematic drawing of an embodiment of a current supply that matches a voltage drop across the voltage regulator with a voltage drop across a current regulator.

Referring to FIG. 6, a specific embodiment of a current source 110 is shown. A first summing amplifier 68 and ripple filter circuit is indicated within dashed enclosure at 112. An error amplifier circuit is indicated at 114 and is electrically coupled to the first filter 78 and limiter 82 which are disposed within dashed enclosure 116. A second summing amplifier is disposed within dashed enclosure 118 and electrically coupled between the limiter 82 and the second filter 80. Second filter 80 is disposed within dashed enclosure 120. A driver 64 and voltage regulator circuit is disposed within dashed enclosure 122 and a current regulator 46 is disposed within dashed enclosure 124. The current source shown in FIG. 6 is a specific embodiment of a current source that includes the indication of specific components and may operate in the manner discussed above with regard to the current source embodiment shown in FIG. 3.

With regard to the above detailed description, like reference numerals used therein refer to like elements that may have the same or similar dimensions, materials and configurations. While particular forms of embodiments have been illustrated and described, it will be apparent that various modifications can be made without departing from the spirit and scope of the embodiments of the invention. Accordingly, it is not intended that the invention be limited by the forgoing detailed description.

What is claimed is:

1. A method of efficiently dissipating heat in a low noise current source, comprising:

providing a current source having a power supply, a voltage regulator which has a heat sink coupled thereto and which is electrically coupled to the power supply and a current regulator which has a heat sink thermally coupled thereto and which is electrically coupled to the voltage regulator;

measuring a power supply output voltage;

measuring a current regulator output voltage; and adjusting a voltage drop across the voltage regulator to substantially match a voltage drop across the current regulator including adding the power supply output voltage and the current regulator output voltage to generate a voltage sum, dividing the voltage sum by 2 to determine a desired voltage, comparing the desired voltage to a voltage regulator output voltage and computing a voltage error value between these voltages, and using the voltage error value to generate an input signal to the voltage regulator to adjust the voltage regulator output voltage to a value between the value of the power supply output voltage and the current regulator output voltage.

2. The method of claim 1 wherein the value of the voltage regulator output voltage is adjusted to a value that is about halfway between the value of the power supply output voltage and the current regulator output voltage.

3. A method of efficiently dissipating heat in a low noise current source, comprising:

providing a current source having a power supply, a voltage regulator which has a heat sink coupled thereto and which is electrically coupled to the power supply, a current regulator which has a heat sink thermally coupled thereto and which is electrically coupled to the voltage regulator and a processing device configured to regulate a voltage drop across the voltage regulator to match a voltage drop across the current regulator including a processing circuit having input terminals coupled to an output of the power supply, an output of the voltage regulator and an output of the current regulator and having a signal driver coupled to the voltage regulator with a first summing amplifier electrically coupled to an output of the power supply and an output of the current regulator, an error amplifier electrically coupled to the first summing amplifier, a second summing amplifier electrically coupled to the error amplifier and a driver which is electrically coupled between the second summing amplifier and the voltage regulator; and adjusting a voltage drop across the voltage regulator to substantially match a voltage drop across the current regulator wherein the first summing amplifier measures and adds the power supply output voltage and the current regulator output voltage and divides the sum of these voltages by 2 to determine a desired voltage, the error amplifier compares the desired voltage to the voltage regulator output voltage and computes a voltage error value between these voltages, the voltage error value is processed by the limiter which generates a voltage limit value, the voltage limit value is processed by the second summing amplifier which generates an input signal to the driver which in turn generates an input signal to the voltage regulator to adjust the voltage regulator output voltage to a value halfway between the value of the power supply output voltage and the current regulator output voltage.

* * * * *